US007445349B2

(12) United States Patent
Yu

(10) Patent No.: US 7,445,349 B2
(45) Date of Patent: Nov. 4, 2008

(54) LIGHT EMITTING DIODE FAN PEN

(76) Inventor: Sun Yu, 2850 Coolidge Hwy., Berkley, MI (US) 48072

( * ) Notice: Subject to any disclaimer, the term of this patent is extended or adjusted under 35 U.S.C. 154(b) by 126 days.

(21) Appl. No.: 11/356,749

(22) Filed: Feb. 17, 2006

(65) Prior Publication Data

US 2007/0195529 A1 Aug. 23, 2007

(51) Int. Cl.
*F21V 21/30* (2006.01)

(52) U.S. Cl. ..... 362/35; 362/96; 362/253

(58) Field of Classification Search ..... 362/35, 362/96, 249, 253; 401/195, 185
See application file for complete search history.

(56) References Cited

U.S. PATENT DOCUMENTS

| | | | | |
|---|---|---|---|---|
| 5,082,422 | A * | 1/1992 | Wang | 416/5 |
| 5,083,881 | A | 1/1992 | Yoshinaga | |
| D329,088 | S | 9/1992 | Yuen | |
| D354,979 | S | 1/1995 | Tsuji | |
| D354,984 | S | 1/1995 | Tsuji | |
| 6,036,331 | A * | 3/2000 | Acquisto | 362/96 |
| D423,575 | S | 4/2000 | Lowe | |
| 6,120,262 | A * | 9/2000 | McDonough et al. | 417/424.1 |
| 6,175,354 | B1 * | 1/2001 | Blissett et al. | 345/110 |
| D482,064 | S | 11/2003 | Steiner et al. | |
| 6,789,162 | B1 * | 9/2004 | Talagala et al. | 711/112 |
| 7,161,256 | B2 * | 1/2007 | Fang | 290/1 R |
| 7,179,149 | B2 * | 2/2007 | Chernick et al. | 446/242 |
| 7,183,939 | B1 * | 2/2007 | Lo et al. | 340/815.53 |
| 2004/0004828 | A1 * | 1/2004 | Chernick et al. | 362/35 |

* cited by examiner

*Primary Examiner*—John A Ward
(74) *Attorney, Agent, or Firm*—Gifford, Krass, Sprinkle, Anderson & Citkowski, P.C.

(57) ABSTRACT

A light emitting diode fan pen is provided that includes a rotatable fan leaf that is coupled to an electric motor. A circuit board is also rotatably coupled to the fan leaf and electric motor. At least one light emitting diode in electrical communication with the circuit board is visible on the fan leaf. A battery producing a voltage sufficient to energize the motor, and a switch for selectively forming an electrical circuit is provided. A housing at least partially encompassing the motor and the switch has an apical end at which the motor is located. An ink reservoir is within the housing. A voltage step-up circuit is provided on the circuit board to receive a voltage output from the battery step-up voltage produced by the step-up subcircuit to power the at least one light emitting diode. A multimode switch is provided to provide a user with various fan operational modes.

20 Claims, 5 Drawing Sheets

LIGHT EMITTING DIODE FAN PEN

FIELD OF THE INVENTION

The present invention relates to a combination article that includes a pen and an illuminated fan.

BACKGROUND OF THE INVENTION

Previous attempts to combine an operable fan and a pen have met with limited success owing to the tendency of the fan to topple over in operation. The necessity of multiple battery power sources to power a motor and a light source contribute to this high center of gravity. The broadening of the fan base for stabilized fan operation comes at the cost of the expense of making the article cumbersome and less amenable to carrying. Thus, there exists a need for a fan pen that functions well as both a writing instrument and a portable personal fan.

SUMMARY OF THE INVENTION

A light emitting diode fan pen is provided that includes a rotatable fan leaf that is coupled to an electric motor. A circuit board is also rotatably coupled to the fan leaf and electric motor. At least one light emitting diode in electrical communication with the circuit board is visible on the fan leaf. A battery producing a voltage sufficient to energize the motor and a switch for selectively forming an electrical circuit between the battery, the motor and the circuit board are also provided. A housing at least partially encompassing the motor and the switch has an apical end at which the motor is located. The housing terminates in a basal end that has an aperture therein. An ink reservoir within the housing is projectable from the aperture in the basal end. A voltage step-up circuit is provided on the circuit board to receive a voltage output from the battery step-up voltage produced by the step-up subcircuit to power the at least one light emitting diode. A multimode switch is provided to provide a user with various fan operational modes. A cap is also provided with a flared base and an opening, the opening selectively engaging the basal end of the housing so as to support the housing in a vertical orientation.

DETAILED DESCRIPTION OF THE PREFERRED EMBODIMENTS

Figure 1:
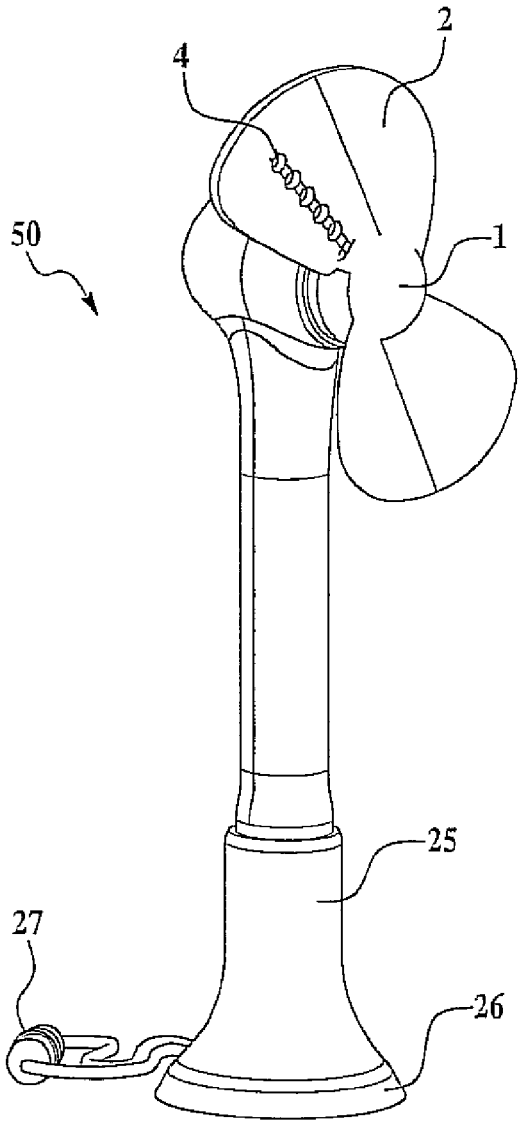
Figure 1 PRIOR ART
FIG. 1 is a perspective view of a prior art LED fan pen.
Figure 2:
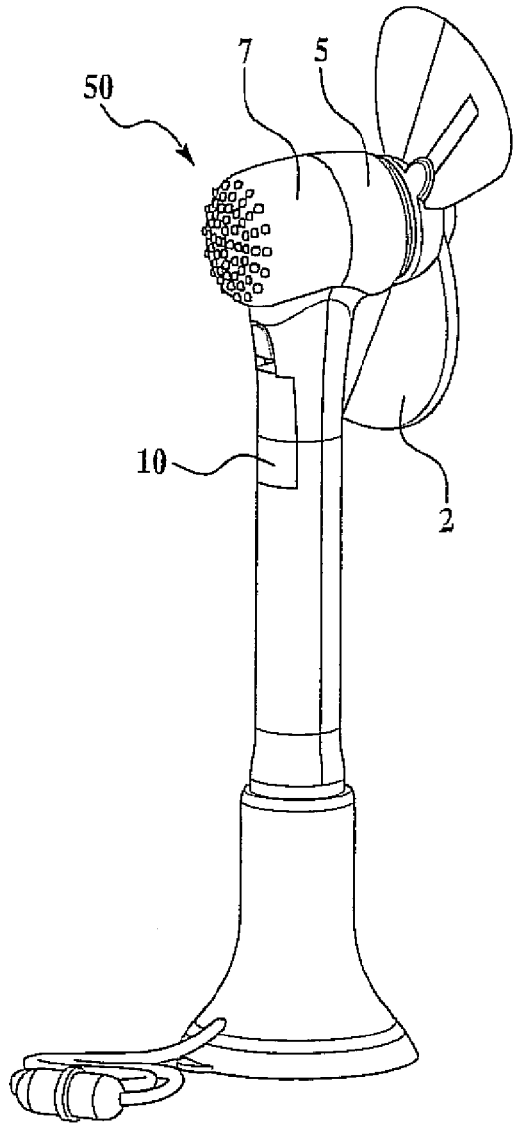
Figure 2 PRIOR ART
FIG. 2 is an orthogonal perspective view of the prior art LED fan pen depicted in FIG. 1.
Figure 3:
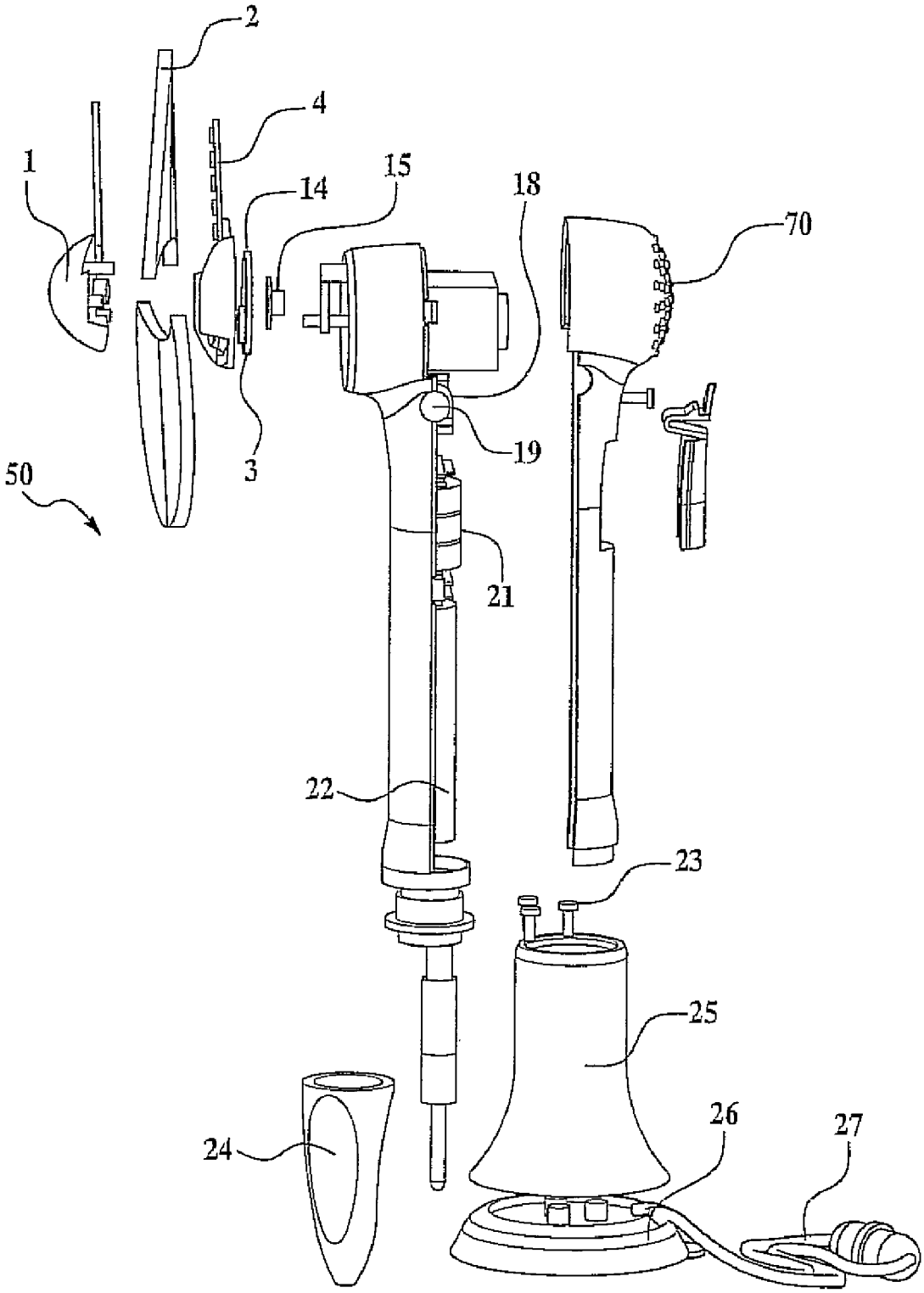
Figure 3 PRIOR ART
FIG. 3 is an exploded side view of the prior art LED fan pen of FIG. 1.
Figure 4:
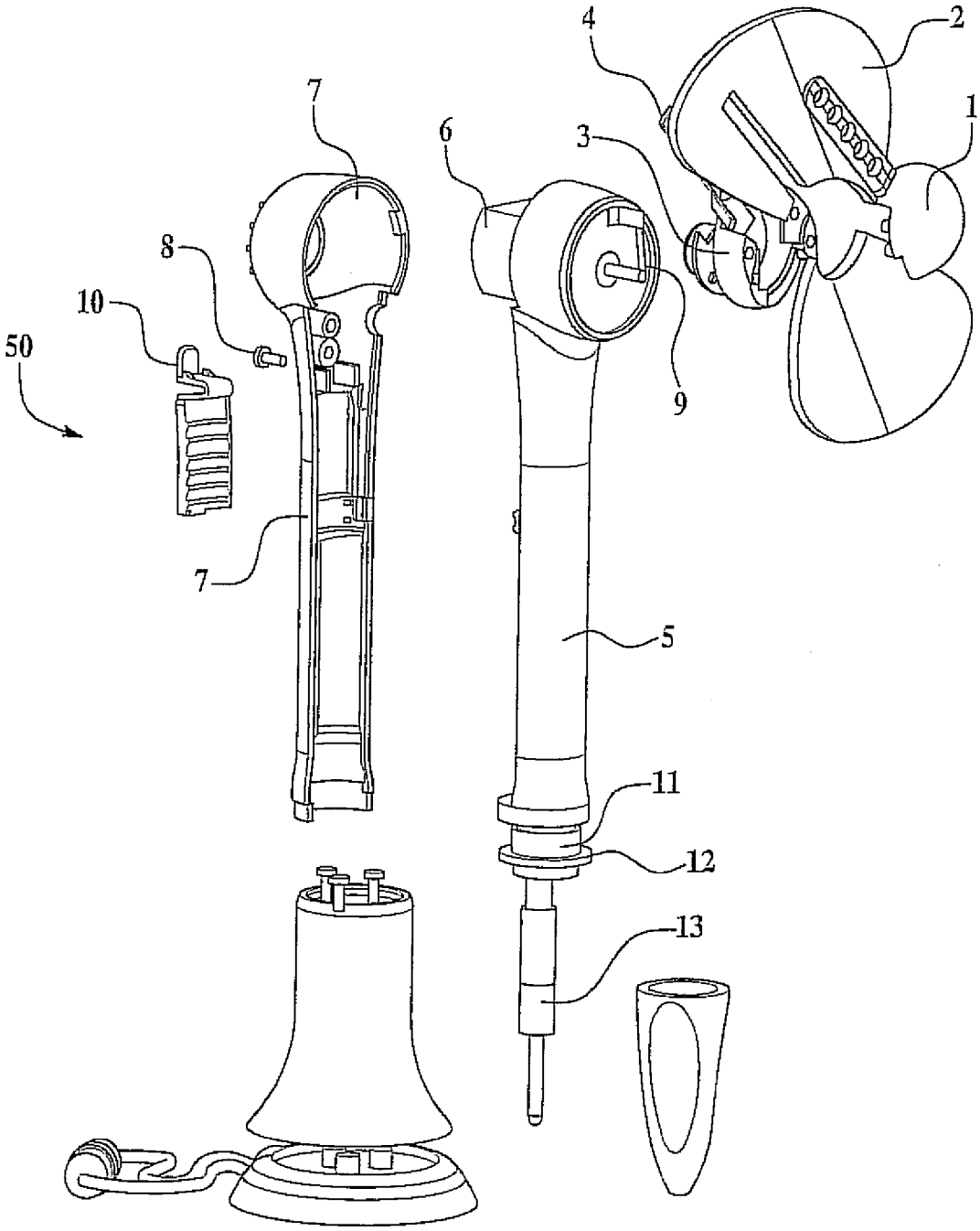
Figure 4 PRIOR ART
FIG. 4 is an exploded view of the prior art LED fan pen depicted with the same perspective as FIG. 1.
Figure 5:
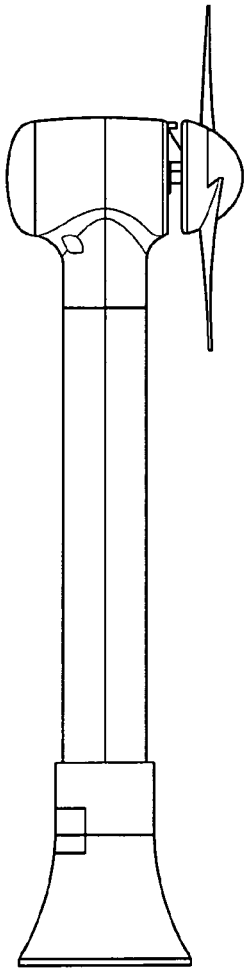
FIG. 5 is a side view of an inventive embodiment of an inventive LED fan pen.
Figure 6:
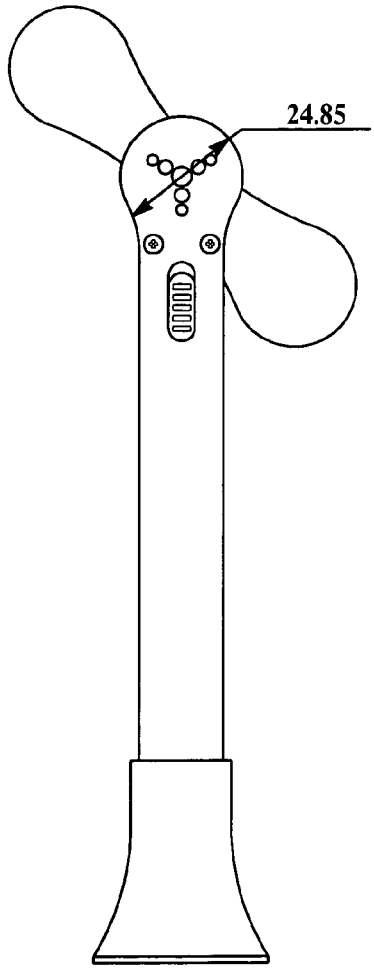
FIG. 6 is a rear view of the inventive pen embodiment of FIG. 5.
Figure 7:
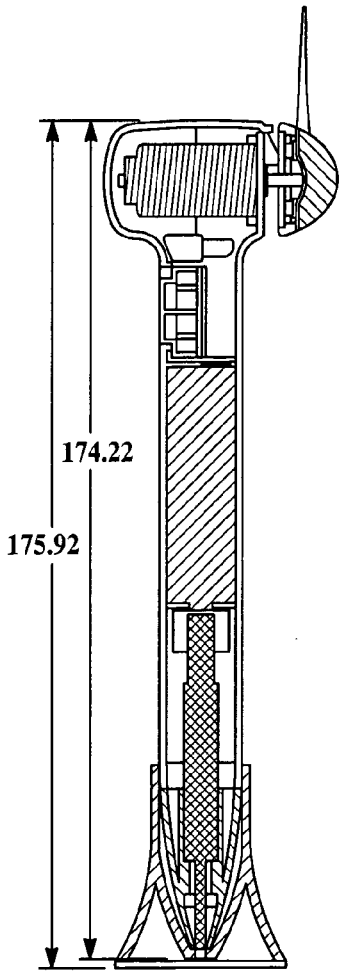
FIG. 7 is a cross-sectional view of the inventive pen embodiment of FIG. 5.
Figure 8:
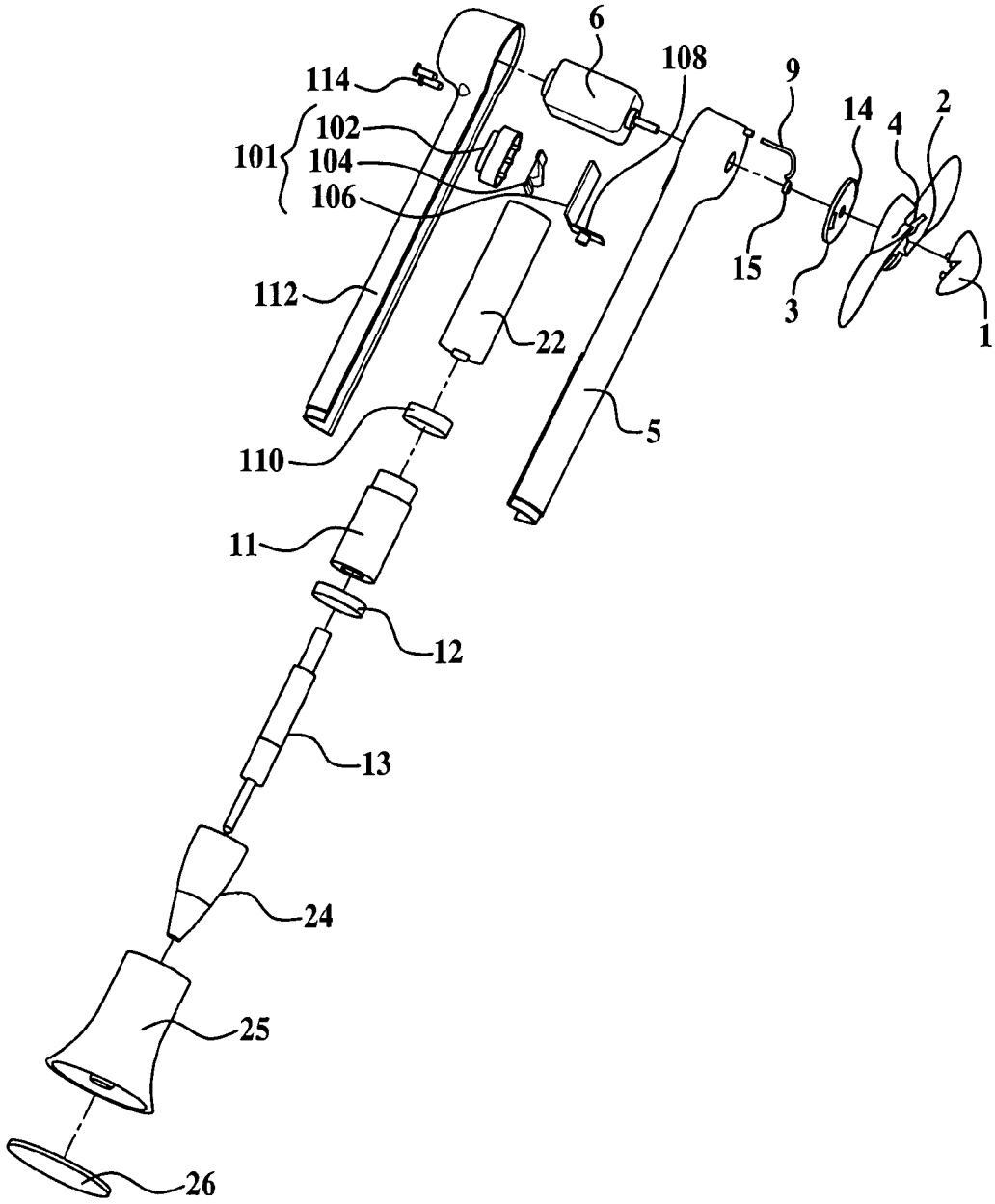
FIG. 8 is an exploded view of the alternate inventive pen embodiment depicted in FIG. 5.

The present invention has utility as a combination pen and portable personal fan emissive of light and able to operate in a fan mode without toppling. An entertainment effect is also produced through the inclusion of at least one light emitting diode within the fan leaf. Referring now to FIGS. 1-4, a prior art LED fan pen is depicted generally at 50. The pen 50 has a spin top 1. The spin top 1 secures a fan leaf 2 to a rotary hub 3. A light emitting diode (LED) linear array 4 is integrated into the hub 3 with a complementary cutout for the LED array 4 being formed in a fan leaf 2. The spin top 1 has a protective frame in overlying contact with the LED array 4. The spin top 1 retains the fan leaf in contact with the hub 3 through press fittings alone, or in combination with a pressure adhesive. A circuit board 14 includes electronic components for illuminating the LED array 4. The circuit board 14 secures behind the hub 3. An electrically conductive axle pin covering 15 is provided intermediate between an electric motor 6 and the circuit board 14—hub 3 that rotates upon activation of the electric motor 6. A brush 9 is provided to electrically couple the circuit board 14 with a power supply and switch so as to illuminate the LED array 4. While the covering 15 and brush 9 are readily formed of a variety of electrically conductive materials, preferably these components are formed of copper or a conductive copper-containing alloy. The electric motor 6 resides within an apical end of the housing formed collectively from housing portions 5, 7 and 24. The housing portions 5, 7 and 24 are formed of thermoplastic materials such as those detailed with respect to spin top 1. The housing portions 5 and 7 are complementary and encompass at least a portion of the electric motor 6, as well as battery power supplies 21 and 22. An aperture 70 is provided in the housing portion 7 underlying the electric motor 6 to facilitate continued motor operation. An access door 10 is provided to facilitate battery replacement. Owing to the different voltage requirements of the electric motor 6 and the LED array 4, a higher output voltage battery power supply 21 is provided to energize the circuit board 14 and induce emission in the LED array 4. As depicted in FIG. 3, the LED battery power supply 21 is a series of button batteries. Electric motor 6 has a separate battery power source 22 that owing to the battery weight also serves to lower the center of gravity of an inventive LED fan pen 50. The use of two battery power sources adds to the cost and raised center of gravity of the pen 50.

An electrical circuit is formed between the electric motor power source 22 and the electric motor 6 through the depression of button 19 against electrical contact 18. Upon completion of a circuit between the motor power source 22 and electric motor 6 by completion of a circuit between button 19 and contact 18, the electric motor 6 rotates so as to drive the hub 3 in a circular fashion inducing air motion. Likewise, the depression of button 8 induces formation of an electrical circuit between LED battery power supply 21 and the LED array 4 by way of the electric brush 9, electrically conductive axle pin covering 15, and circuit board 14. In this way, the operation of the fan and LED array can be locked with depression of button 19 followed by depression of locking pin 8.

A pen core clip 11 inserts in a basal opening between housing portions 5 and 7. A ring 12 secures against the base of the housing portions 5 and 7 and secures the pen core clip 11 in place. Rotation of a lower portion 13 of a pen core relative to the pen core clip 11 causes extension of the pen core. Housing portion 24 is adapted to seat against the ring 12 and press fit against the lower portion 13 of the pen core. As a result of rotating the housing portion 24, a pen tip selectively extends and retracts relative to a pen tip aperture in the housing portion 24.

The housing portion 24 is adapted to seat within a cap 25. The cap 25 has a base 26 with the cap 25 and base 26 being joined together with mechanical fasteners 23. The base 26 is weighted and stabilizes the LED fan pen 50 such that operation of the fan does not cause the pen 50 to topple from a vertical position. A lanyard 27 is optionally provided to facilitate the suspension and carrying of the pen 50.

A inventive LED fan pen is shown in general at 100 in FIGS. 5-8 where like numerals correspond to those detailed above with respect to FIGS. 1-4. The spin top 1, fan leaf 2, hub 3, LED array 4, and circuit board 14 are secured to the shaft of an electric motor 6 by way of an electrical induction axle pin covering 15. The spin top 1 is formed of a thermoplastic material and preferably is injection molded. Thermoplastic materials operative herein illustratively include polystyrene, acrylonitrile, butyl styrene, and polyalkylenes. An electric brush 9 provides electrical communication between the circuit board 14 and the LED array 4 with a battery source 22. A battery source 22 provides operational power to the motor 6 and the LED array 4. In the event that a light emitting diode has greater voltage requirements than the voltage output of the battery source 22, a voltage step-up subcircuit is provided intermediate between the power source 22 and the LED array 4. Preferably, the voltage step-up circuit is integrated into the circuit board 14. Voltage step-up circuits are well known to the art. An exemplary voltage step up circuit operative herein to power the light emitting diode having required input voltage greater than the voltage output from the battery source 22 is known as a Cockroft-Walton circuit. Intermediate between the power source 22 and the power consumptive electric motor 6 and LED array 4, a switch mechanism 101 is provided. The switch mechanism 101 includes a switch button 102, a spring clip 104, and a circuit board 106. Negative pole electrical contact 108 is provided in selective electrical contact with the power consumptive electric motor 6 and the LED array 4 based on the relative position of the clip 104. A positive electrical contact 110 in conjunction with the negative electrical contact 108 bound the battery source 22. The switch button 102 is formed of an electrically nonconductive material such as a thermoplastic. The switch button 102 controls the position of the electrically conductive clip 104 relative to the circuit board 106 to selectively form an electrical circuit. The switch button 102 has a number of positions to form alternate circuits and provide multiple modes of operation for an inventive pen 100. Such modes of operation illustratively include motor and LED array both off, motor on-LED array off, motor and LED array on for a limited time duration, and both motor and LED array on continuously. The electric motor 6, switch mechanism 101, power source 22, and battery contacts 108 and 110 are at least in part secured within housing portions 5 and 112. The housing portion 112 is formed of a thermoplastic material relative to housing portion 5. The housing portions 5 and 112 are secured together by conventional means illustratively including pressure adhesives, welding and mechanical fasteners. As depicted with respect to FIGS. 5-8, mechanical fasteners 114 urge the housing portions 5 and 112 together.

A pen core clip 104 inserts in a basal opening between housing portions 5 and 112. A ring 12 secures against the base of the housing portions 5 and 112 and secures the pen core clip 11 in place. Rotation of a lower portion 13 of a pen core relative to the pen core clip 11 causes extension of the pen core. Housing portion 24 is adapted to seat against the ring 12 and press fit against the lower portion 13 of the pen core. As a result of rotating the housing portion 24, a pen tip selectively extends and retracts relative to a pen tip aperture in the housing portion 24.

The housing portion 24 is adapted to seat within a cap 25. The cap 25 has a base 26 with the cap 25 and base 26 being joined together with mechanical fasteners 23. The base 26 stabilizes the LED fan pen 100 such that operation of the fan does not cause the pen 100 to topple. A lanyard is optionally provided to facilitate the suspension and carrying of the pen 100.

Patent documents and publications mentioned in the specification are indicative of the levels of those skilled in the art to which the invention pertains. These documents and publications are incorporated herein by reference to the same extent as if each individual document or publication was specifically and individually incorporated herein by reference.

The foregoing description is illustrative of particular embodiments of the invention, but is not meant to be a limitation upon the practice thereof. The following claims, including all equivalents thereof, are intended to define the scope of the invention.

The invention claimed is:

1. A light emitting diode fan pen comprising:

a fan leaf;

an electric motor having a shaft coupled to said fan leaf;

a circuit board;

a voltage step-up subcircuit receiving the voltage output from said battery and delivering a voltage greater than the voltage output to one of said electric motor or said at least one light emitting diode;

at least one light emitting diode in electrical communication with said circuit board and rotatably secured to said electric motor;

a battery producing a voltage output;

a switch for selectively forming an electrical circuit between said battery, said motor and said circuit board;

a housing at least partially encompassing said motor and said switch, said housing supporting said motor and terminating in a basal end.

2. The pen of claim 1 wherein voltage step-up subcircuit is on said circuit board.

3. The pen of claim 1 wherein the voltage is delivered to said at least one light emitting diode and is greater than two volts.

4. The pen of claim 1 wherein said at least one light emitting diode is a plurality of light emitting diodes.

5. The pen of claim 1 wherein said at least one light emitting diode is visible on said fan leaf.

6. The pen of claim 1 wherein said switch is a multimode switch having at least three operational settings of both said motor and said at least one LED off and at least two settings selected from the group consisting of: motor and LED array both off, motor on-LED array off, motor and LED array on for a limited time duration, and both motor and LED array on continuously.

7. The pen of claim 1 further comprises a cap having a flared piece and an opening, the opening selectively engaging the basal end of said housing, said housing supported in a vertical position in said cap.

8. The pen of claim 7 wherein said cap further comprises a lanyard.

9. The pen of claim 1 wherein the apical end of said housing has a motor ventilation aperture.

10. The pen of claim 6 wherein said at least one light emitting diode is a plurality of light emitting diodes receiving an activation voltage via a voltage step-up subcircuit.

11. A light emitting diode fan pen comprising:

a fan leaf;

an electric motor having a shaft coupled to said fan leaf;

a circuit board rotatably coupled to said motor and said fan leaf;

at least one light emitting diode in electrical communication with said circuit board and rotatably secured to said electric motor;

a battery producing a voltage output;

a switch for selectively forming an electrical circuit between said battery, said motor and said circuit board;

a housing at least partially encompassing said motor and said switch, said housing supporting said motor and terminating in a basal end;

wherein said switch is a multimode switch which has operational settings of said motor on-said at least one LED off, and said motor and said at least one LED on for a limited time duration.

12. The pen of claim 11 wherein the voltage is delivered to said at least one light emitting diode and is greater than two volts.

13. The pen of claim 11 wherein said at least one light emitting diode is a plurality of light emitting diodes.

14. The pen of claim 11 wherein said at least one light emitting diode is visible on said fan leaf.

15. The pen of claim 11 further comprising a cap having a flared piece and an opening, the opening selectively engaging the basal end of said housing, said housing supported in a vertical position in said cap.

16. The pen of claim 11 further comprising a voltage step-up subcircuit receiving the voltage output from said battery and delivering a voltage greater than the voltage output to one of said electric motor or said at least one light emitting diode.

17. The pen of claim 1 wherein said motor is in an apical end of said housing.

18. The pen of claim 1 wherein the basal end has an aperture therein and an ink reservoir is within said housing and projecting from the basal end.

19. The pen of claim 11 wherein said motor is in an apical end of said housing.

20. The pen of claim 11 wherein the basal end has an aperture therein and an ink reservoir is within said housing and projecting from the basal end.

* * * * *